US010392087B2

(12) United States Patent
Acosta

(10) Patent No.: US 10,392,087 B2
(45) Date of Patent: Aug. 27, 2019

(54) PERIPHERAL TUNNELS PROPELLER WITH ALTERNATIVE BALANCE

(71) Applicant: Jose Angel Acosta, Maracaibo (VE)

(72) Inventor: Jose Angel Acosta, Maracaibo (VE)

( * ) Notice: Subject to any disclaimer, the term of this patent is extended or adjusted under 35 U.S.C. 154(b) by 252 days.

(21) Appl. No.: 15/275,255

(22) Filed: Sep. 23, 2016

(65) Prior Publication Data

US 2017/0088244 A1 Mar. 30, 2017

Related U.S. Application Data

(60) Provisional application No. 62/222,887, filed on Sep. 24, 2015.

(51) Int. Cl.
*B63H 1/18* (2006.01)
*B63H 1/12* (2006.01)
*B63H 1/28* (2006.01)

(52) U.S. Cl.
CPC ..... *B63H 1/18* (2013.01); *B63B 2745/00* (2013.01); *B63H 2001/127* (2013.01); *B63H 2001/283* (2013.01)

(58) Field of Classification Search
CPC ..... B01F 7/00; B01F 7/00733; B01F 7/02; B01F 7/16; B63B 2745/00; B63B 2745/04; B63H 1/12; B63H 1/18; B63H 1/28; B63H 2001/127; B63H 2001/185; B63H 2001/283; B63H 2001/286; F01D 1/34; F04D 3/02; F04D 29/442; F04D 29/447
USPC ..... 416/90 A, 91, 93 A, 144, 179, 181, 416/231 R, 245 A, 247 A
See application file for complete search history.

(56) References Cited

U.S. PATENT DOCUMENTS 54,891 A * 5/1866 Gelston ..... A47L 15/13 261/33
895,399 A * 8/1908 Gill ..... B01F 13/002 416/64
1,438,012 A * 12/1922 Bauer ..... B63H 1/16 415/72
2,276,404 A * 3/1942 Lundquist ..... F04D 29/288 116/147
2,616,511 A * 11/1952 Perrott ..... B63H 1/16 416/193 R
2,771,240 A * 11/1956 Gurin ..... F01D 5/027 301/5.22

(Continued)

*Primary Examiner* — Joshua E Rodden
(74) *Attorney, Agent, or Firm* — Jose Angel Acosta

(57) ABSTRACT

This disclosure is related with propeller noise and cavitation abatement in applications like propulsion, ventilation, pumping or turbine systems on fluids by novel techniques that allows stronger propellers with improved laminar flow by means of a propeller which consists on a rotating cylindrical block or a truncated substantially conical block with one or more tunnels around it rotational axis, said block also may have flow-guiding structures at both ends that help to keep the fluid's laminar flow when it is mixing fluids with its environment, having the rotating block tunnels with either substantially circular shaped cross-section or variable shape cross-section from substantially circular to irregular oval measured in perpendicular plane to the rotational axis whereby it smoothly accelerates fluid or gas by means of either centrifugal or axial movement, also including Dynamic Balance or Imbalance or Torque Modulation Means that modulate specific vibrations which generates sound waves.

8 Claims, 6 Drawing Sheets

(56) References Cited

U.S. PATENT DOCUMENTS

| | | | | | |
|---|---|---|---|---|---|
| 2,903,076 | A * | 9/1959 | Johannesen | B63H 1/16 | 416/189 |
| 3,148,736 | A * | 9/1964 | Skopyk | B63H 1/16 | 416/189 |
| 3,444,817 | A * | 5/1969 | Caldwell | F04D 29/22 | 415/218.1 |
| 3,512,762 | A * | 5/1970 | Umbricht | B01F 3/04539 | 209/169 |
| 3,986,704 | A * | 10/1976 | Risse | B01F 7/00241 | 366/290 |
| 4,358,245 | A * | 11/1982 | Gray | F01P 7/06 | 123/41.49 |
| 4,875,829 | A * | 10/1989 | Van der Woude | B63H 1/20 | 416/2 |
| 5,415,524 | A * | 5/1995 | Gamble | B63H 1/16 | 416/145 |
| 2011/0020109 | A1* | 1/2011 | Acosta | B63H 1/12 | 415/90 |
| 2012/0020794 | A1* | 1/2012 | Cooper | F04D 7/065 | 416/179 |
| 2016/0061213 | A1* | 3/2016 | Lavagna | F04D 29/2216 | 415/83 |

* cited by examiner

PERIPHERAL TUNNELS PROPELLER WITH ALTERNATIVE BALANCE

CROSS-REFERENCE TO RELATED APPLICATIONS

This is an improvement to invention in U.S. Pat. No. 9,157,324 issued Oct. 13, 2015 previously application Ser. No. 12/838,343, filed Jul. 16, 2010 and provisional Application No. 61/228,133 filed on Jul. 23, 2009 both filed by the Applicant. This Application claims priority on the provisional Application No. 62/222,887 filled on Sep. 24, 2015 under 35 USC § 119(e) and 120. The disclosure of said patent is hereby incorporated by reference into the present application.

BACKGROUND OF THE INVENTION

Field of Invention

The invention disclosed herein relates to propeller improvement, particularly to noise and cavitation abatement on propellers used on marine propulsion, fluid pumps, fans, and power turbines. Noise is always undesirable collateral of machine function, is source of illness, operational restrictions, and service life shortened on devices affected by noise. It is also a security concern to deal with when quiet operation is required.

Discussion of the Prior Art

Propellers accelerate a fluid by impinging it against a rotating blade. Such acceleration provides the thrust to an object to which it is connected. A common cause of noise is created by the fluid's turbulence, cavitation and the vibration of the propellers' blades. Some designs achieve lower noise by means of a hardened blade structure, or surrounding the entire propeller with a duct. Other designs also reinforce the blade structure linking all blades to a ring at the propeller perimeter. Other designs use screw-type blade propellers, and some restrict the operational envelope to avoid go beyond cavitation and vibration.

Turbulence often in the blade itself, the flat shape of a blade in circular movement generates parasite waves that generate turbulence. This turbulence generates noise when the fluid knocks against the blade's surface or other structures near the propeller. This fluid impact creates structural tension that when released generates sound waves. To reduce the noise caused by the structural tension, reinforcements to the propeller blade structures are introduced. Some reinforcement strategies use a greater blade section or use reinforced materials on blade structures. Others use a ring attached at the extremes of the blades surrounding the propeller (see U.S. Pat. Nos. 1,441,852; 1,518,501 and 4,684,324 and their citations), early propeller designs contemplated cylindrical bodies surrounding helical passages this provided the propeller the strongest body possible but actually does little on noise (see U.S. Pat. No. 04,963), Peripheral Tunnels Propellers are the ones made from a member with hollow conduits, this application is related to this kind of propeller, specifically the Peripheral Tunnels Propeller U.S. Pat. No. 9,157,324, which this application improves.

The basic technique of laminar turbulence reduction on the blades has been to design screw blade propellers as on U.S. Pat. No. 1,518,501. The blades described therein have an open semicircular chamber, which shapes help to avoid turbulence generated by flat shapes and also helps to reduce the angular momentum perturbation on the particles, other techniques contemplated replacing the blades by skewed pipe sections acting as blades while addressing partially some of the noise and cavitation sources actually introduced new noise and turbulence to the system since is well known pipe as any tubular member is excellent structure for sound resonance, while requiring stronger construction due higher structural loads (French Patent FR536766B), The Peripheral Tunnels Propeller U.S. Pat. No. 9,157,324 addressed also the issue related to the fluid's angular momentum by restricting the tunnel's cross-section to one perfect circular in continuous perpendicular plane to the rotational axis from end to end, said application also anticipates fluid guidance structures attached among each tunnel pairs to further reduce fluid turbulence while being introduced or exhausted to the tunnels.

The Inertial cavitation phenomena have origin when the fluid pressure falls below its vapor pressure due high acceleration momentum. The cavitation causes shock waves that are a powerful noise source. Prior art systems are designed to reduce cavitation by using larger diameter propellers to move a bigger volume (and mass) of fluid at a lower acceleration. Other systems inject gas under pressure. As expected, this avoids the shock waves but introduces a new source of noise to the system due the turbulence generated by such gas (see U.S. Pat. No. 4,188,906 and its citations).

The solution associated to this invention (The Peripheral Tunnels Propeller) consist to accelerate the fluids while being confined into a chamber which cross-section avoids perturbation on the fluids angular momentum relative to the rotational axis, or in other words keeps a constant cross-section shape at any rotational angle across the propeller chord measured in perpendicular plane to the rotational axis, thus avoiding a major source of noise and cavitation, notwithstanding this technique introduces a higher friction its quietness is easily notable (U.S. Pat. No. 9,157,324).

The solution offered by the applicant on his Peripheral Tunnels Propeller U.S. Pat. No. 9,157,324 foresee introduction of aerodynamically shaped structures among adjacent tunnel's ends to help smoothly merge the fluids within its environment, as well variations on tunnel's section shape according the application.

Active Dynamic Imbalance or Balancer System have been developed for a while, i.e. the "Rotational balancer" WATSON U.S. Pat. No. 3,812,724A (see its references) consist on Masses distributed about the rotating device provided by some sort of actuator that reposition it in opposite response to the rotating device vibration, other systems uses fluids as masses (U.S. Pat. No. 5,490,436), different masses arrangements and a control system, but basically all requires some mass body following the rotating device and re-positioned in a way that the inertial vibration is fully compensated, no other usage have been foreseen for these systems yet, the inventor disclosed on U.S. Pat. No. 9,157,324 that induce acceleration or vibration to an perfectly balanced Peripheral Tunnel Propeller (and some other propeller designs too) is useful disguising the propeller or also cancel the propeller's sounds, a novelty here disclosed is a way to achieve this is by taking advantage of the existing Active Dynamic Imbalance system by re-purposing it by introducing periodical "signals" into its control system this way modifying specific sectorial un-balance on the propeller as well introducing torque modulation which induces the desired sound waves required to disguise or cancel sounds, as well known Active Dynamic Imbalance system have either digital electronic or analog mechanical or electronic control system coordinating the Balance Masses Positioning, for the purpose and intends in this invention this system are useful by modulating the input signals it uses to measure the propeller Imbalance.

BRIEF SUMMARY OF THE INVENTION

The present invention is a propeller device comprising, as a preferred embodiment, a right perfect circular cylindrical block with one or more peripheral tunnels in one or more rows, each tunnel describing a helical tunnel around a central axis, each tunnel having cross-section which starts at one end with an circular shape in perpendicular plane to the rotation axis which progressively reshapes into an substantially ellipsoid shaped cross-section shape in a perpendicular plane to the rotational axis along to the opposite tunnel end. Each tunnel having an input end and an output end disposed at each end face of the cylindrical block, respectively. Having aerodynamically contoured flow-mixing devices among adjacent tunnels disposed at each input and output comprising aerodynamically contoured structures attached at the tunnel's ends, and having a Multi-Function Balance or Imbalance Device acting as a Selectable Periodic Imbalance or Balance System or as Periodic Torsional Momentum Modulator distributed about the structure and driven by means external to the propeller itself.

Alternative embodiments are foreseen, comprising: a truncated substantially conical structure having the input and output at the flat ends and said flat ends being in perpendicular plane to the rotational axis. Also, the tunnel's cross-sections relative to the rotational axis being shaped either as continuous shape perfect circular in continuous perpendicular plane to the rotation axis from end to end or having said tunnel cross-sections a circular shape in perpendicular plane to the rotation axis which progressively reshapes into a substantially ellipsoid shaped cross-section shape in a perpendicular plane to the rotational axis along to the opposite tunnel end.

The aerodynamically contoured flow-mixing structures, is defined having a shape as a progressive chamfer extended among the middle section from adjacent tunnels, having a shape at its base which correspond to the gap among the adjacent tunnels where it is disposed, as the structure extends from its base, the shape in parallel plane the structure's base is progressively reshaped and area reduced until it conforms a single edge with the shape of a line proportional to the adjacent tunnels perimeter.

To move a fluid, is needed to transfer movement from the engine to the fluid. On propellers, rotating the propeller does this. Prior art propellers have a flat, concave or convex shape. When the propeller moves, the propeller's blades applies force against the fluid, which is greater at the propeller extreme ends because of a higher relative speed at the extreme end of each blade. Also the fluid will have a counter-revolving movement due its own inertia. The fluid being accelerated tends to keep its momentum with respect to the surrounding environment fluids. Such fluid momentum shift is the origin of the fluid's turbulence and parasite shock waves.

The present invention in its preferred embodiment, achieves its goal of noise abatement by displacing the fluid into a plurality of rotating cylindrical passages (or tunnels) each having a circular shaped cross section relative to the perpendicular plane to the rotational axis continuously at one end which maybe constant or progressively reshaping to another cross section substantially elliptical at the other end. With continuous circular cross sections when a fluid is displaced inside said chambers, each molecule keeps its inertial momentum measured in perpendicular plane to the tunnels rotation (hereafter the perpendicular momentum), given the peculiarity that circular shapes do not have edges the molecules are keep at a constant distance relative to the tunnel's walls, only the axial movement is transferred. This keeps such inertial momentum unchanged in a plane relative to the rotational axis, given that a circular shape is constant regardless the angular movement relative to the starting position this minimize turbulence caused by hitting against the walls of the chamber (induced perturbation of the perpendicular momentum of the fluid). However progressively reshaping this cross-section to another substantially ellipsoid is not as effective avoiding turbulence as the constant circular cross-section in perpendicular plane to the rotational axis but allows for an easier massive manufacturing with modular molds.

Embodiments comprising substantially conical structures allow a more effective propeller action given that takes advantage of the centrifugal force instead to rely only on the axial movement.

The Basic principia on which is based this invention is discussed on the related invention U.S. Pat. No. 9,157,324, this application covers embodiments not anticipated in enough detail by the related invention, as the variable cross-section progressively reshaped from perfect circular shape to an substantially ellipsoid shape measured in perpendicular plane to the rotational axis, as well the conical embodiments that's take advantage of the centrifugal force to increase the propeller effectiveness. The cross section when is not perfect circular in perpendicular plane to the rotational axis still induces noise and turbulence, but given the fluids come from un-perturbed movement at the side with circular cross-section this turbulence is minimal, allowing designs easier to massively build by well-known molding techniques.

DETAILED DESCRIPTION OF THE INVENTION

Figure 1A:
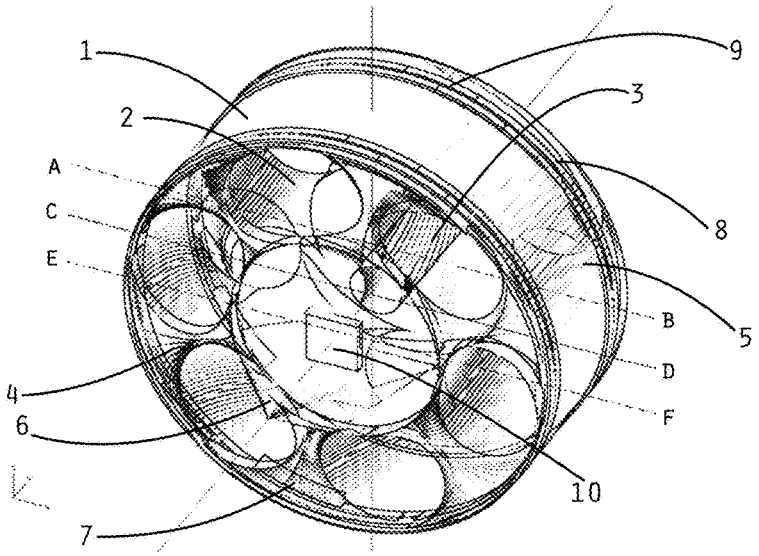
FIG. 1*a* and FIG. 1*b* are a perspective and side views respectively of a Quiet Propeller of the present invention.
Figure 1B:
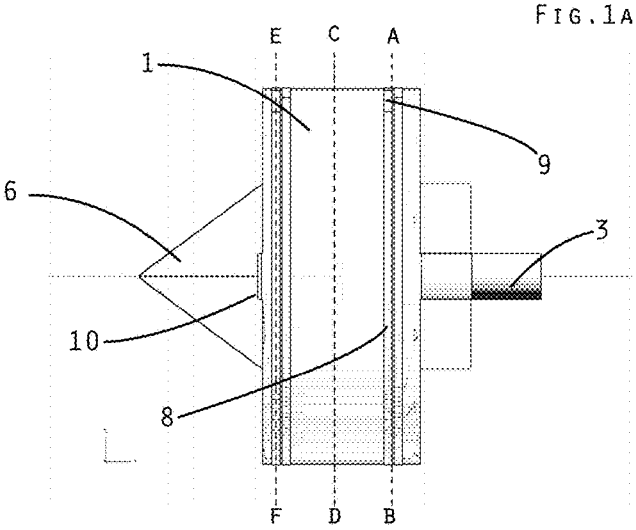

Referring now to the drawings in more detail, in FIG. 1*a* and FIG. 1*b* there is shown a cylindrical block 1 having, in its preferred embodiment, multiple peripheral holes as spiraling tunnels 2 with inlet and outlet ends. An inner shaft 3 provides rotation guide and torque to spin the cylindrical block. Fluid guide structures 4, 5 are located at each end. The cylindrical structure on its preferred embodiment ends on a conical or spherical structure 6, the Lines A-B, C-D, E-F defines a reference plane perpendicular to the rotational axis which cross-section is detailed on FIG. 1*c*, FIG. 1*d* and FIG. 1*e*, the illustrator also depicts the active dynamic imbalance means, comprised by mass 9, ring 8, actuator 7 and the control hub 10.

Figure 1C:
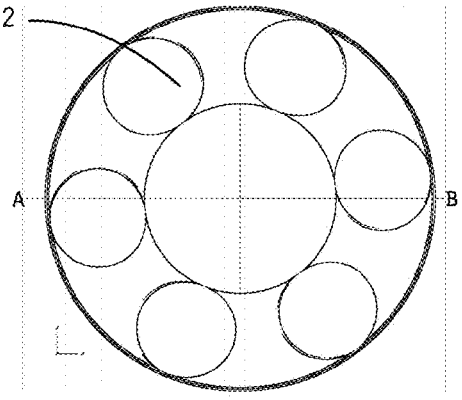
FIG. 1*c* is a cross-section view at the A-B line in FIG. 1*a* of the present invention.
Figure 1D:
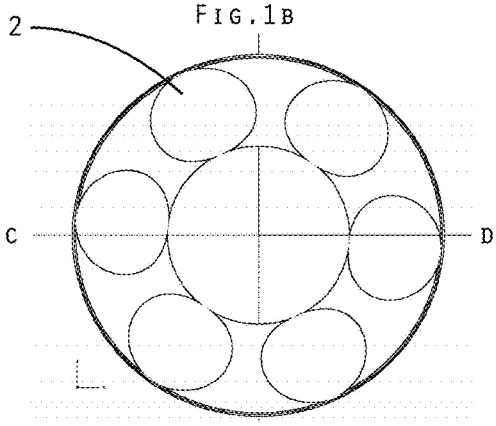
FIG. 1*d* is a cross-section view at the C-D line in FIG. 1*a* of the present invention.
Figure 1E:
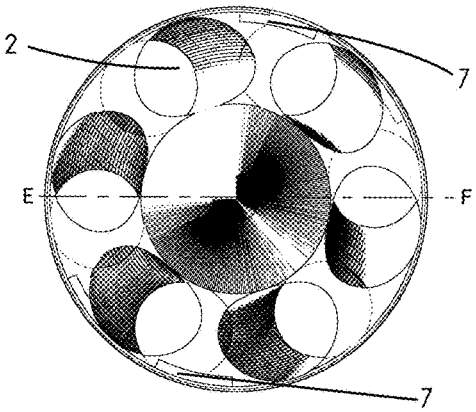
FIG. 1*e* is a cross-section view at the E-F line in FIG. 1*a* of the present invention.

In more detail, still referring to the same embodiment, FIG. 1*c* depicts the tunnel's cross section 2 as Circular at the A-B line (input end), FIG. 1*d* depicts the cross-section of the same tunnel cross-section 2 semi-circular at the C-D line, FIG. 1*e* depicts the cross-section 2 as irregular ellipsoidal flattened in direction to the rotational axis in the same tunnel at the E-F line (output end).

The shape of each tunnel section 2 at the A-B Line, C-D line or the E-F line is measured in perpendicular plane to the rotational axis, while this embodiment names it as a irregular ellipse as final shape, is understood that the final shape could be any ellipse variation or ellipse-like shape, in the preferred embodiment the ellipsoidal shape is relatively flatten in direction to the propeller's rotational axis, FIG. 1*e* also depicts the actuator 7 positioned between a pair of adjacent tunnel inside the gap among them.

Figure 2A:
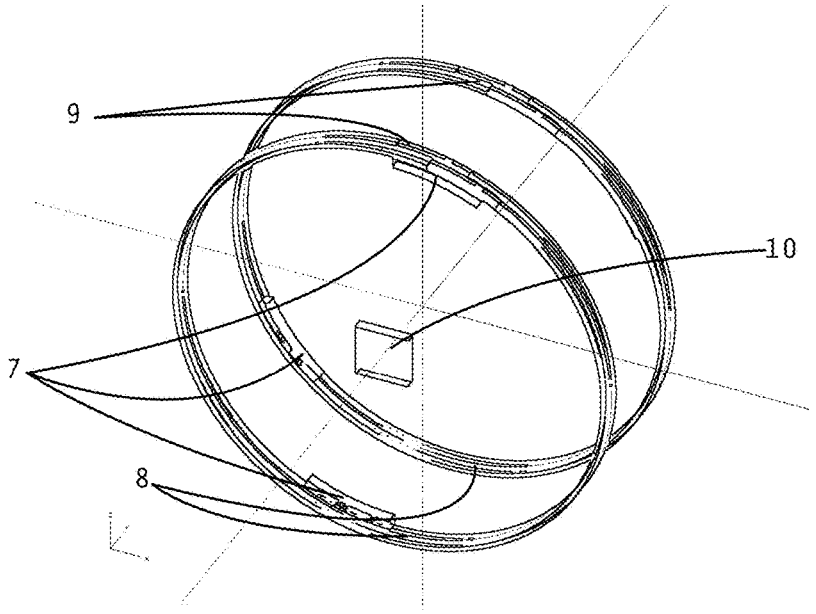
FIGS. 2*a* to 2*c* are a perspective, front and side view respectively of a Multifunction Dynamic Balance or Imbalance/Torque Modulation Means in a Quiet Propeller of the present invention.
Figure 2B:
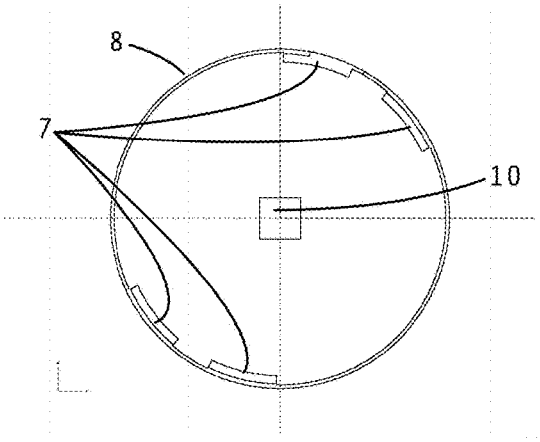
Figure 2C:
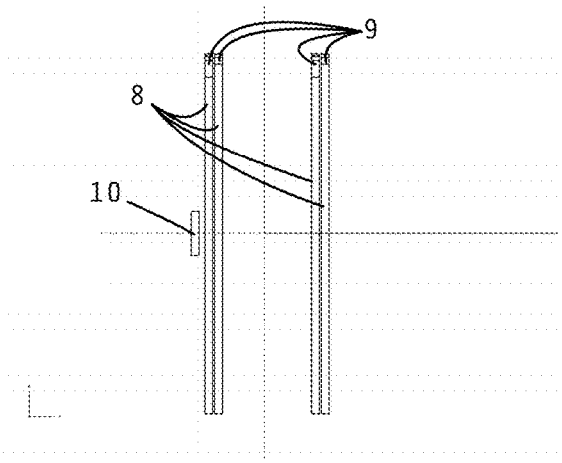

FIG. 2 depicts an embodiment for a Multifunction Dynamic Balance or Imbalance/Torque Modulation Means as a movable mass 9 mounted on a ring 8 distributed about the propeller block 1 (shown in FIGS. 1*a*, 1*b*) along with its actuators or reposition means 7, and controls hub 10 (where the accelerometer are installed to monitor the propeller balance and calculate then the right mass position to balance the system), the power means is not shown (i.e. electrical control means or mechanic linkages) but is understood the device should be powered properly, while this preferred embodiment depicts an multifunction dynamic balance or imbalance/torque modulation means specific to be installed on configurations like peripheral tunnels propellers taking advantage of the gap among adjacent tunnels and its external cylindrical perimeter, is understood this feature could be implemented with almost any Active Dynamic Imbalance system suitable to modify its control means, as long it can fit inside the gap among adjacent tunnels and the cylinder perimeter, in this propeller among the multi-purpose characteristic of the Active Dynamic Imbalance device, another novelty is to install such devices using the gap space among each tunnel pairs avoids operational turbulence and protects the system from damage due contact on or with external objects.

Still referring to the Multifunction Dynamic Imbalance or Balance system, this specific configuration being installed two sets of active dynamic imbalance system near each end is due the specific and particular characteristic inherent to all the peripheral tunnel propellers, the Imbalance could vary along the propeller chord, being more Imbalanced near some end than the other, so for a proper effective Imbalance, the system requires specific balance actions different at each end, the location of the Multifunction Dynamic Imbalance system control hub unit is shown here close to the propeller shaft behind the cone, while this is an ideal location for such system is understood other suitable arrangements are possible as distributing the unit along the actuators or in other locations attached or not to the propeller, even at remote locations outside the propeller itself.

Figure 3A:
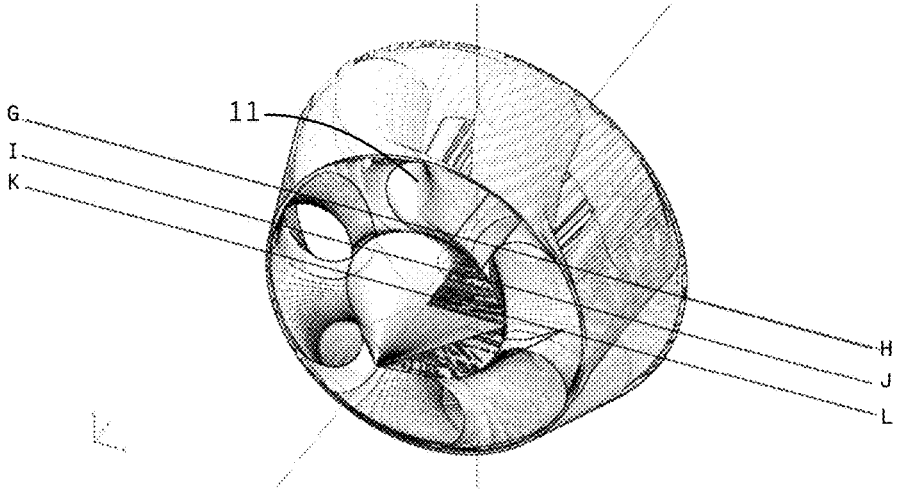
FIG. 3*a* and FIG. 3*b* are a perspective and side views respectively of an alternate embodiment to the propeller depicted from FIGS. 1*a* to 1*c* but having a substantially conical build and variable shaped tunnels cross-section starting from circular at one end progressively reshaping to a substantially ellipsoid shape at the other end.
Figure 3B:
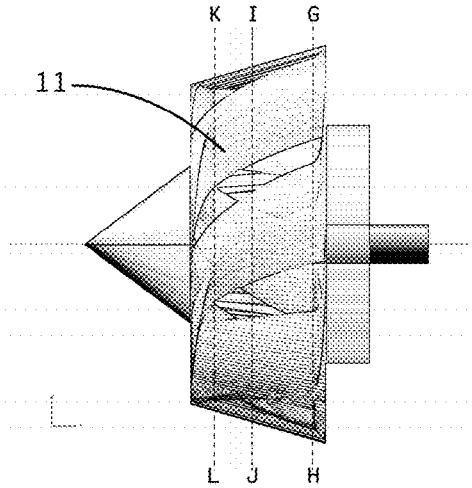
Figure 3C:
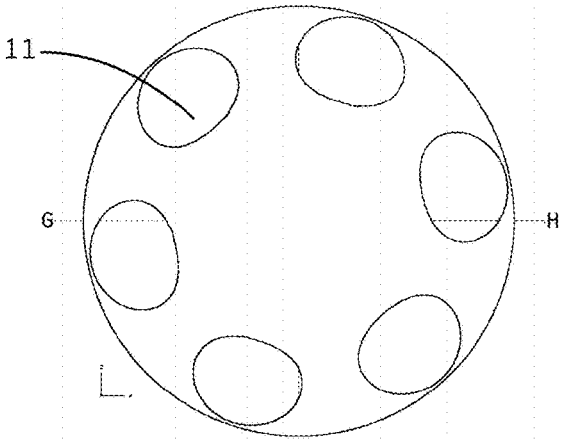
FIG. 3*c* is a cross-section view at the G-H line in FIG. 3*a* of the present invention.
Figure 3D:
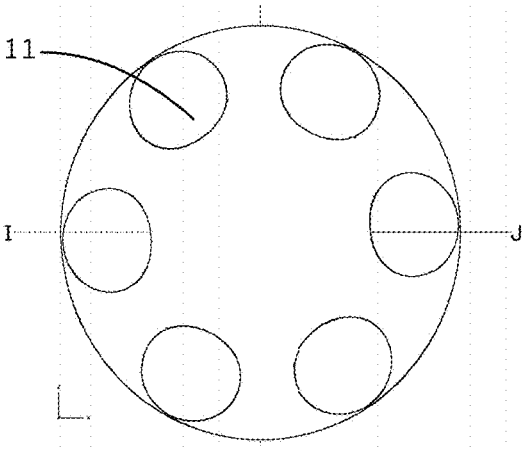
FIG. 3*d* is a cross-section view at the I-J line in FIG. 3*a* of the present invention.
Figure 3E:
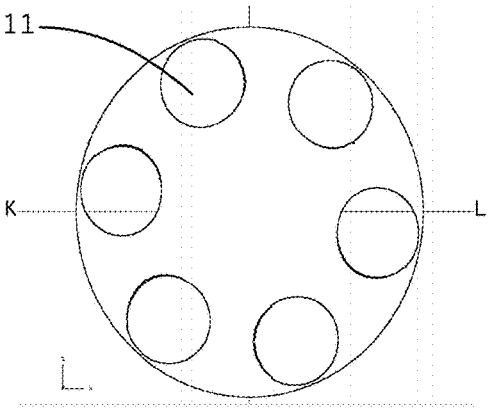
FIG. 3*e* is a cross-section view at the K-L line in FIG. 3*a* of the present invention.

Referring to FIG. 3*a* there is shown an alternate embodiment to the propeller depicted by FIGS. 1*a* to 1*c* with Conical build having multiple peripheral holes 11 as spiraling tunnels with inlet and outlet ends. The Lines G-H, I-J, K-L defines a reference plane perpendicular to the rotational axis which cross-section related to tunnel 11 is detailed on FIG. 3*b*, FIG. 3*c* and FIG. 3*d*.

Figure 4A:
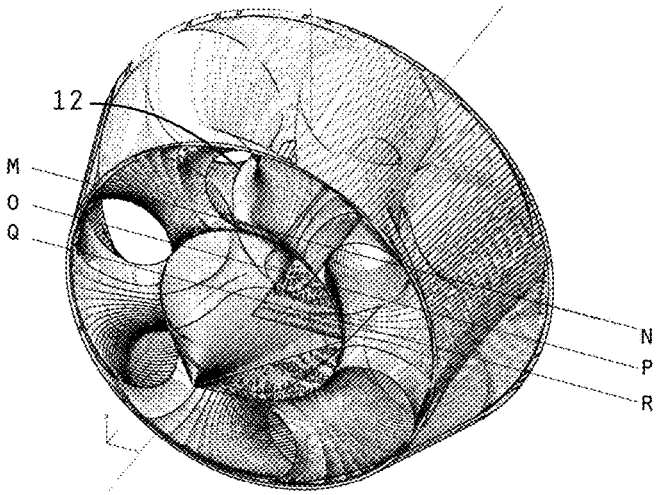
FIG. 4*a* and FIG. 4*b* are a perspective and side views respectively of an alternate embodiment to the propeller depicted from FIGS. 1*a* to 1*c* but having substantially circular shaped cross-section with an progressively increasing area from end to end.
Figure 4B:
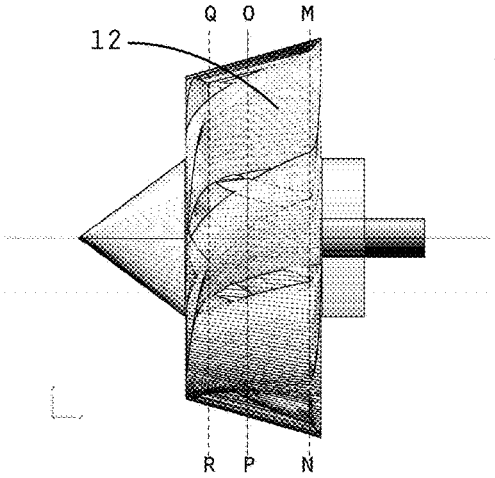

Referring to FIG. 4*a* there is shown an alternate embodiment to the propeller depicted by FIG. 1*a* having a Truncated Substantially Conical block having multiple peripheral holes 12 as spiraling tunnels with inlet and outlet ends. The Lines M-N, O-P, Q-R defines a reference plane perpendicular to the rotational axis which cross-section related to tunnel 12 is detailed on FIG. 4*b*, FIG. 4*c* and FIG. 4*d*.

Figure 4C:
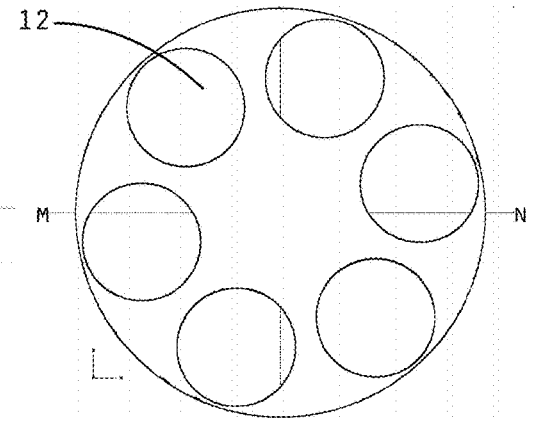
FIG. 4*c* is a cross-section view at the M-N line in FIG. 4*a* of the present invention.
Figure 4D:
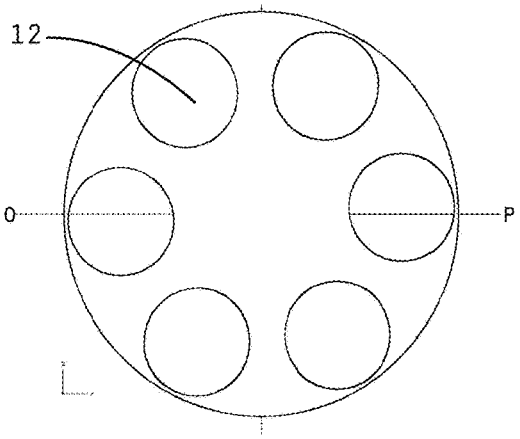
FIG. 4*d* is a cross-section view at the O-P line in FIG. 4*a* of the present invention.
Figure 4E:
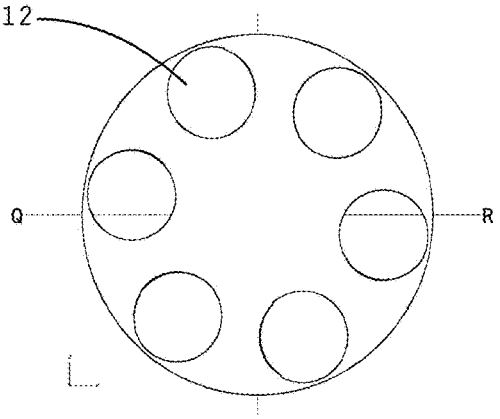
FIG. 4*e* is a cross-section view at the Q-R line in FIG. 4*a* of the present invention.
Figure 5A:
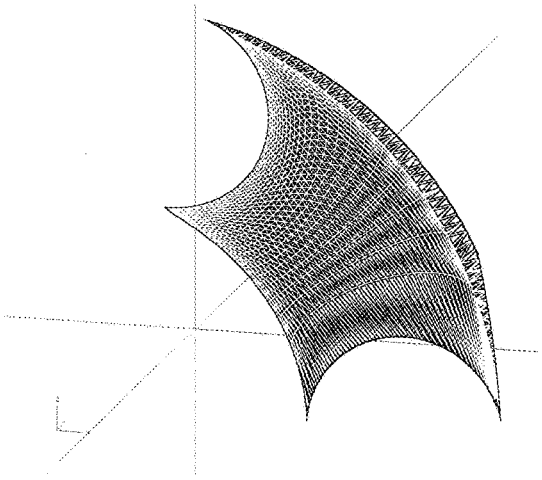
FIG. 5*a* is a perspective view of a Flow Guide Structure (referenced as structures 4 in all embodiments and as structure 5 by embodiments depicted by FIGS. 4*a* to 4*c*)
Figure 5B:
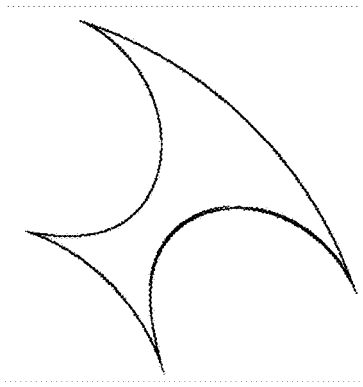
FIGS. 5*b* to 5*d* are sectional cutout of said flow guide structure all in parallel plane to the structure base, which is in perpendicular plane to the rotational axis of the propeller.
Figure 5C:
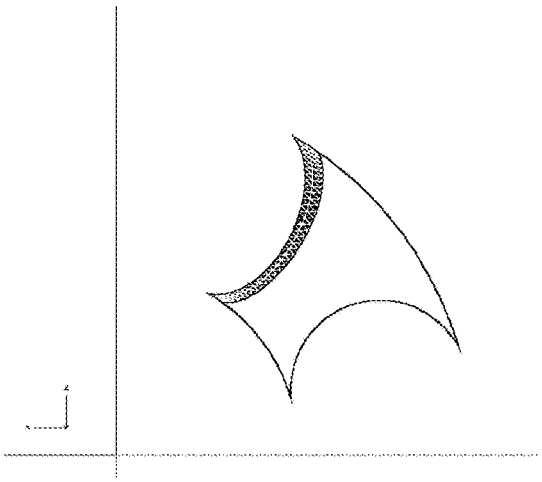
Figure 5D:
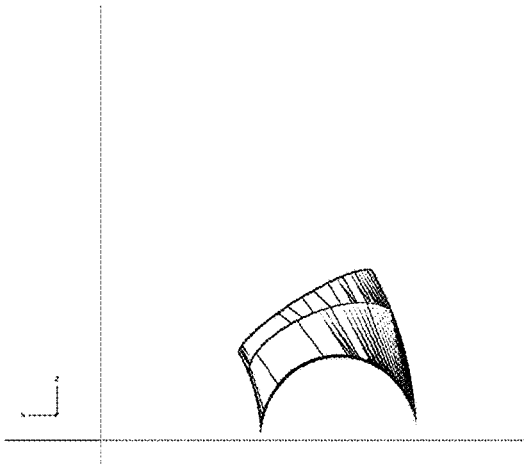
Figure 6A:
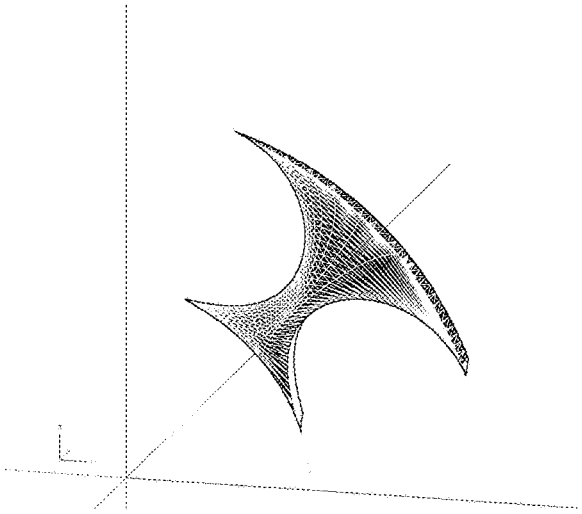
FIG. 6*a* is a perspective view of a Flow Guide Structure (as structure 5 in FIGS. 1*a* and 1*n* embodiment depicted by FIG. 3*a*) in a propeller having tunnels with irregular oval cross-section at the output.
Figure 6B:
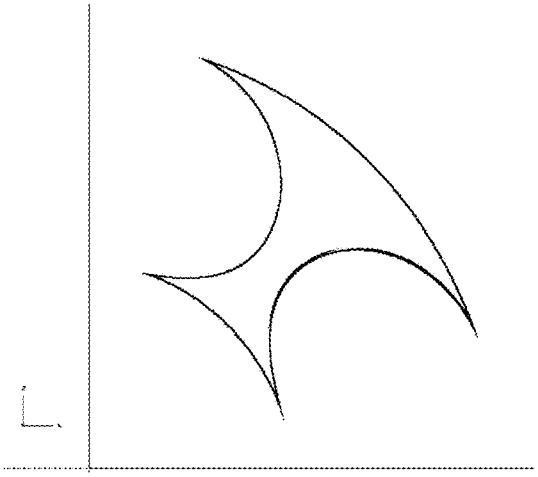
FIGS. 6*b* to 6*d* are sectional cutout of said flow guide structure all in parallel plane to the structure base which is in perpendicular plane to the rotational axis of the propeller.
Figure 6C:
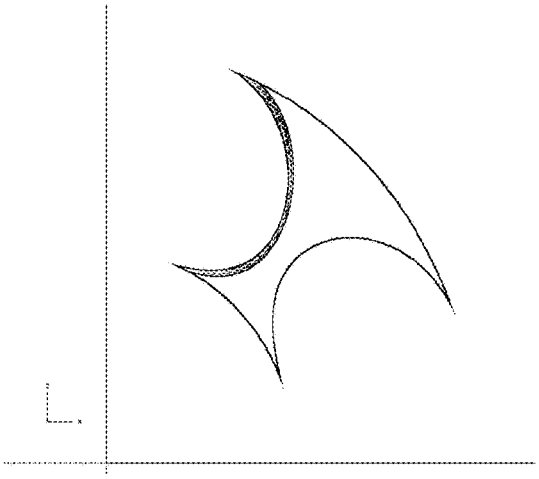
Figure 6D:
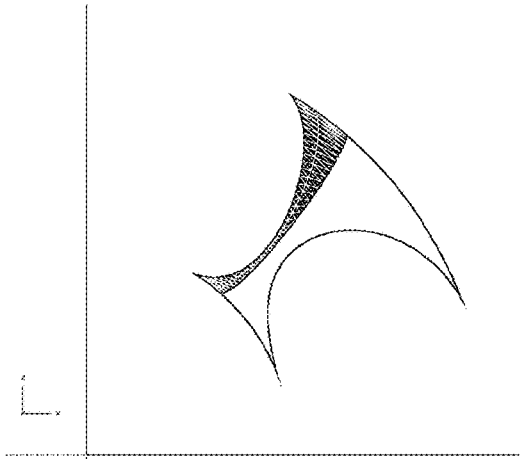

In more detail, still referring to the same embodiment of FIG. 4*c*, FIG. 4*d* and FIG. 4*e* depicts the tunnel's cross section 12 as Circular at the M-N, O-P, Q-R line (from end to end).

Operation

The invention achieves its goal to accelerate a fluid by spinning it inside a camber (tunnel 2,11,12) driven by shaft 3 and by both combined centrifugal and axial movement it accelerates the mass of fluid from the input end to the output end. The tunnels have the particularity that each section matches the circular momentum of the molecules, avoiding parasite sound waves due to wall collision, and thus keeping Reynolds numbers at laminar flow levels. The input and output structures 4 and 5 provide paths for input and output of the fluids through the tunnels 2,11,22 and blend smoothly with the environment. The physical structure of the cylindrical block is inherently so strong that material stress just can't make sound waves or the environment easily attenuates such waves at elevated frequency and low decibels. Other elements such as the conical structure 6 help to keeps the fluid at laminar flow conditions.

The Multifunction Dynamic Balance or Imbalance/Torque Modulation Means 7, 8, 9, 10 consist on any Active Dynamic Balancer device suitable to be permanently installed on the propeller and suitable to have a modified control system which modification consist that at certain propeller angles or sectors generates arbitrary balance or un-balance conditions so the Active Dynamic Balancer corrects this actually nonexistent un-balance or balance conditions with periodical harmonic Imbalance, this Imbalance could be used as source for sound-waves which are useful either to disguise the machine or to cancel or disguise some of the machine natural sounds, i.e. from propeller rotating from 0° to 90° the Balancers is set to balance the propeller, from 90° to 180° the balancer control unit is modified to Imbalance the propeller by 0.1 G then from 180° to 270° the balancer is set again to balance the propeller and so on, thus the propeller having two times per revolution a 0.1 G vibration also its possible on some Active Dynamic Balancer to induce "virtual un-balance" without actually Imbalance the propeller but inducing variation on the propeller momentum this way effectively modulating Only the torque with similar goals create specific sound waves on the propeller for either disguise or cancellation of the machine natural sound, this functionality requires a propeller where it can be embedded without modification to its functional shape as the peripheral tunnel propeller aforementioned.

Although the embodiments shown include all features, the applicant specifically contemplates that features 4, 5, 6, 7, 8, 9 and 10 disclosed herein may be used together or in combination with any other feature on any embodiment of the invention. It is also contemplated that any of the cited features may be specifically excluded from any embodiment of an invention.

Construction

The construction details of the invention as shown in FIG. 1*a*, FIG. 3*a* and FIG. 4*a* are the block 1 could be made from fiber glass reinforced composites, metal alloy, ceramics, reinforced concrete, and any material suitable for fabrication of such pieces. The shaft 3 could be made of the same material as the block 1 or from higher strength materials such as steel. If made from a different material, the block 1 must be built around a previously machined shaft 3. The input and output structures 4 and 5 maybe made from the same material the cylindrical block 1. Conical structure 6 is made from the same material as the cylindrical block 1. In the preferred embodiment, the cylindrical block 1 and the intake and exhaust structures 4 and 5 and the conical structure 6 all are built as a single body.

The Cylindrical block 1 could if desired be integrated with an Multifunction Dynamic Balance or Imbalance/Torque Modulation Means, as the basic Active Dynamic Balancer system 7,8,9,10 optimally installed using the gap among each pair of adjacent tunnels, but its control system is modified to receive periodic arbitrary input signals by suitable means according the desired sound, the Balancer/Un Balancer system maybe mechanical, fluidic or electromechanical as on as the Balancer System from prior art, but this system besides the desired Imbalance patterns receives indication from a sensor on the propeller shaft about the propeller rotational angle, then compares it to the desired un-balance or un-balance and introduces signal to the balancers system accordingly the opposite desired un-balance, suitable Active Dynamical Balancer system suitable for this purpose include without limitation those in prior art with: Moving masses, reciprocating masses, rods pulley, liquid masses, as long those system receive some input suitable to be modified on described purpose.

Intake and exhaust structures 4 and 5 maybe defined as a aerodynamically contoured chamfer, having a shape as an annular sector extended among the contiguous adjacent tunnels, said shape at its base is concave at each immediate tunnel side and congruent with the immediate tunnel's semi cross-section which correspond to the gap among the adjacent tunnels where it is disposed, as the structure extends from its base, the shape in parallel planes to the structure's base is progressively reshaped by varying progressively one concave side up to shaping it as convex and congruent with the opposite concave side until it conforms a single edge with the shape of a concave line, this concave line maybe symmetrically or asymmetrically disposed among the tunnels.

The advantages of the present invention include, without limitation: Quieter operation, very strong structure on a wide variety of materials not suitable on other designs, resiliency to damage due the permanent availability of an active balance system and the materials it allows to use on its manufacture, capability to generate specific sound waves useful to disguise other noises or cancel it. The present invention is environmentally friendly minimizing injuries to humans or animals in the surrounding environment by presenting continuous surfaces on both the exterior structure and interior tunnels.

The invention size depends on specific applications: The cylindrical block 1 maybe as small as 2 millimeters or less, and as big as 50 meters or more limited only by the fabrication process. The longitudinal proportion depends on the length of tunnels 2,11,12 required to accelerate the fluid just below the cavitation inertial limit. The number of tunnels 2,11,12 in the preferred embodiment, are six in a single row not being limited to these numbers and maybe one or more tunnels, distributed on one or more tunnel rows.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

The invention claimed is:

1. A propeller comprising a truncated substantially conical block spinning around a rotation axis, said conical block having a plurality of holes as helical tunnels surrounding the rotation axis, each of the holes having inlet and outlet at each end face of the conical block, respectively, wherein each end face of the conical block is disposed at each end of the conical block, said conical block having a plurality of flow-guiding structures attached to the ends, said flow-guiding structures comprising an aerodynamically chamfered wedge disposed at each end face and among ends of the holes, said chamfered wedges having a base at the respective end face, said wedges base having a cross-section substantially shaped as an annular sector having concave ends, each end congruent with a semi cross-section of an adjacent one of the tunnels, said wedges cross-section varying progressively its shape at one of the concave ends until said end is shaped convex and is congruent with an opposite one of the concave ends as a base plane rises above the respective end face, Whereby rotation of the conical block induces minimal turbulence on the perpendicular momentum of the fluid inside each respective hole thus avoiding collateral noise and delaying the cavitation phenomena.

2. A propeller as claimed in claim 1 wherein:

said conical block having integrated a Dynamic Balance Means, said Balance Means integral to the conical block and disposed about the rotational axis of said conical block, said Balance Means having a function for a periodically Balance or Imbalance, whereby the propeller generates a specific sound wave.

3. A propeller as claimed in claim 1 wherein:

said conical block having integrated a plurality of Dynamic Balance Means,

Said Balance Means having a function for a periodically Balance or Imbalance, said Balance Means integral to the conical block and disposed about the rotational axis of said conical block, said Balance Means being distributed complementary, where the resultant Balance or Imbalance is compensated and only a periodic torque modulation is introduced to the propeller, whereby the propeller generates a specific sound wave.

4. A propeller comprising a truncated substantially conical block spinning around a rotation axis, said conical block having a plurality of holes as helical tunnels surrounding the rotation axis, each of the holes having inlet and outlet at each end face of the conical block, respectively, wherein each end face of the conical block is disposed at each end of the conical block, said conical block having permanently integrated at least one Dynamic Balance Means, said Balance Means integral to the conical block and disposed about the rotational axis, said Balance Means having a function to balance or Imbalance at specific periods, whereby the propeller generates a specific sound wave.

5. A propeller as claimed in claim 4 further including:

The at least one Dynamic Balance Means including, a plurality of said Dynamic Balance Means, said Balance Means having a function to balance or Imbalance at specific periods, said Balance Means integral to the conical block and disposed about the rotational axis, said Balance Means being distributed complementary, where the resultant Balance or Imbalance is compensated and only a periodically torque modulation is conveyed to the propeller, whereby the propeller generates a specific sound wave.

6. A propeller comprising a truncated substantially conical block spinning around a rotation axis, said conical block having a plurality of holes as helical tunnels surrounding the rotation axis, each of the holes having inlet and outlet at each end face of the conical block, respectively, wherein each end face of the conical block is disposed at each end of the conical block, said holes having cross-sections with substantially circular shape at one end which progressively reshape into an ellipsoidal shaped cross-section at an opposite tunnel end, and said cross-sections lie in constant perpendicular plane to the rotation axis from end to end, said conical block having a plurality of flow-guiding structures attached to the ends, said flow-guiding structures described as aerodynamically chamfered wedge disposed at each end face and among the ends of the holes, said chamfered wedges having a base at the respective end face, said wedges base having a cross-section substantially shaped as an annular sector having concave ends, each end congruent with a semi cross-section of an adjacent one of the tunnels, said wedges cross-section varying progressively its shape at one of the concave ends until said end is shaped convex and is congruent with an opposite one of the concave ends as a base plane rises above the respective end face, Whereby rotation of the conical block induces minimal turbulence on the perpendicular momentum of the fluid inside each respective hole thus avoiding collateral noise and delaying the cavitation phenomena.

7. A propeller as claimed in claim 6 wherein:

said conical block having integrated a Dynamic Balance Means, said Balance Means integral to the conical block and disposed about the rotational axis of said conical block, said Balance Means having a function for a periodically Balance or Imbalance, whereby the propeller generates a specific sound wave.

8. A propeller as claimed in claim 6 wherein:

said conical block having integrated a plurality of Dynamic Balance Means,

Said Balance Means having a function for a periodically Balance or Imbalance, said Balance Means integral to the conical block structure and disposed about the rotational axis of said conical block, said Balance Means being distributed complementary, where the resultant Balance or Imbalance is compensated and only a periodic torque modulation is introduced to the propeller, whereby the propeller generates a specific sound wave.

* * * * *